United States Patent [19]

Cahn

[11] 4,003,786

[45] Jan. 18, 1977

[54] THERMAL ENERGY STORAGE AND UTILIZATION SYSTEM

[75] Inventor: Robert P. Cahn, Millburn, N.J.

[73] Assignee: Exxon Research and Engineering Company, Linden, N.J.

[22] Filed: Sept. 16, 1975

[21] Appl. No.: 613,754

[52] U.S. Cl. ..... 176/39; 176/60; 176/65; 60/644; 60/659

[51] Int. Cl.[2] ..... G21C 15/16

[58] Field of Search ..... 176/39, 60, 65; 20/644, 20/659

[56] References Cited

UNITED STATES PATENTS

| | | | |
|---|---|---|---|
| 3,065,162 | 11/1962 | Hub | 60/644 |
| 3,507,747 | 4/1970 | Strohmeyer | 176/65 |
| 3,575,002 | 4/1971 | Vuia | 60/644 |
| 3,583,156 | 6/1971 | Schabert et al. | 60/644 |
| 3,681,920 | 8/1972 | Margen | 60/652 |
| 3,724,212 | 4/1973 | Bell | 60/644 |
| 3,848,416 | 11/1974 | Bundy | 60/644 |
| 3,886,749 | 6/1975 | Pacault | 60/659 X |
| 3,894,394 | 7/1975 | Braytenbah | 60/644 |

OTHER PUBLICATIONS

Adjustment Apr. Power—Heat, Transactions of the American Nuclear Society, P. Pacault & J. Tillequin, European Nuclear Conf., Paris, France, April 21–25, 1975.

*Primary Examiner*—Samuel W. Engle
*Assistant Examiner*—Peter A. Nelson
*Attorney, Agent, or Firm*—Joseph J. Allocca

[57] ABSTRACT

The power output from a nuclear power plant or fossil fuel power plant operating under constant reactor (or furnace) and boiler conditions is varied by regulating the rate of turbine extraction steam and primary high pressure steam used to heat boiler feed water (BFW). During periods of low power demand excess extraction steam is drawn off to heat excess quantities of boiler feed water. One portion of the BFW is fed to the boiler while the other portion is used to reheat a low vapor pressure (LVP) organic material which hot material is stored under an inert atmosphere at atmospheric pressure in a high temperature storage location means. During periods of high power demand BFW preheat duties would be taken over entirely by the moving LVP organic material, moving from hot to cold storage location means, use of extraction steam for BFW reheat being curtailed and such untapped extraction steam being allowed instead to expand itself fully in the turbines. The boiler at all times receives a constant amount of uniformly preheated BFW.

19 Claims, 5 Drawing Figures

THERMAL ENERGY STORAGE AND UTILIZATION SYSTEM

BRIEF DESCRIPTION OF THE INVENTION

The typical nuclear powered electric generation plant consists of essentially two distinct sections. The heart of the plant is the nuclear reactor, the source of the heat used to generate the steam in the boiler utilized by the turbines and generators. The nuclear reactor and steam boiler represent about 75% of the total investment in nuclear powered electric generating stations and are limited in the degree of flexibility they can exhibit. The steam turbines, condensers, generators, fittings and general electrical facilities represent the remaining 25% of the total investment, are strictly conventional in design and operation and are, further, capable of operation over a relatively wide variation of parameters.

There are many practical objections to throttling the output of a nuclear reactor. A reactor is most efficient when operating at maximum potential. Periodically reducing the output of the reactor reduces the efficiency, increases operating difficulties and hazards and increases the costs of running the plant. This inherent inflexibility of nuclear plants means that they can only be utilized as "base load" plants and that the intermediate load and peak-shaving service have to be met by conventional fossil fuel fired generators (coal or oil-burning boilers or gas turbines, etc.). The expensive nuclear heart of the nuclear powered generation plant is incapable of following load demands and, therefore, a large part of the total daily power requirements are not met by the nuclear plants.

The instant invention relates to a novel way in which, during periods of low power demand, the excess heat output of a steady state nuclear reactor can be stored in low vapor pressure (LVP) organic material stored in a high temperature storage locations means at atmospheric pressure for use during peak demand periods as boiler feed water and interstage steam reheating materials and/or as a means of generating intermediate pressure steam for use directly in the turbines. The invention allows operating the reactor and boiler at maximum steady conditions while the turbines, generators and electrical facilities can fluctuate between about 65–130% or as much as 25%–150% of a base load of 100%. If this 65% is considered the new base load, the nuclear plant will now have a capacity of 100% of base load to peak load following capacity and while operating continuously at maximum efficiency, the plant will be able to utilize the flexibility of the conventional electrical generation apparatus. If the 25% is considered the new base load, the load following capacity can be manyfold the base load capacity.

The present invention is also appliable to modern fossil fuel plants, particularly those based on supercritical steam cycles and those incorporating pollution abatement provisions either in the form of fuel gas preparation or flue gas scrubbing facilities. Since such facilities are very expensive, they, similar to nuclear reactors, force the utility to operate such plants all out as base load stations. Any provision to permit them to follow the load would extend the use of such plants into the intermediate and even peak shaving load ranges.

This invention offers the further advantage of rapid response to demand. The unit can follow the load by adjusting the steam rate to and from the turbine by regulating the amount of preheat and reheat done by extraction steam and the amount of BFW preheat and interstage steam reheat done by hot theremal energy retention material moving between hot and cold storage location means and by advantageously using the ability of the stored hot LVP organic material to raise intermediate pressure steam for use directly in the turbines. Therefore, the present invention must be considered as making totally available the spinning reserve up to the maximum capacity of the turbine-generator combination.

The prior art demonstrates numerous instances in which more efficient utilization of energy by various means and by various types of machinery was sought. British Pat. 381,924 (Oct. 10, 1932) discloses a method for varying the performance of a steam engine (turbine) by increasing or decreasing the preliminary heating of the feed water by tapping the steam stream utilized by the turbine. The preliminary heating of the feed water is controlled in relation to the condition of te load on the subordinate engine giving off the preheating steam. It is possible by this invention to tap the main steam line and either store high temperature water to preheat feed water or to itself serve as hot feed water, or to bleed steam from the turbine exhausts and directly heat the feed water. In this way, it is possible to regulate the performance of the steam engine and more efficiently utilize the fuel burned to supply the heat. At periods of low power demand, boiler feed water is either drawn from a storage tank of cold water and a steam side stream is drawn from the turbine and used to heat the feed water. At periods of high power demand, hot stored water is fed to the boiler and no steam is drawn off from the turbine, all available steam going for the production of power. The performance of the turbine, therefore, is controlled by the amount of steam bled from the turbine in accordance wih power demand requirements. This system is different from the instant invention in that British 381,924 uses water as a heat storage medium. It does not teach a method of storing large quantities of thermal energy for use during peak power demand periods. The hot feed water, according to the patent, is stored in the same container as the cold condensate, the cold water merely being in the bottom portion of the tank while the hot is at the top. Even if separate tanks were utilized, to achieve efficiency in heat storage, high temperature and very high pressure water storage would be necessary.

U.S. Pat. No. 3,681,920 discloses a power plant operating with a varying production of electric power and coupled into an evaporation apparatus. When the plant is operating at low energy production, excess thermal energy is stored in the form of hot water. When the plant is generating peak electric power, the stored hot water is used to run the evaporation apparatus. In this way, relatively uniform and continuous utilization of the evaporator can be achieved through all phases of plant operations. It is readily seen from the above, that this patent is in no way concerned with energy storage for the purpose of meeting energy production deman fluctuation requirements. Further, the heat storage system utilized is high temperature water, which of necessity, would require high pressure storage apparatus for efficient energy containment. If no such pressure equipment is used, the water can only be stored to a maximum of 99° C at atmospheric pressures which means that only a small portion of the potentially available heat energy can be stored.

U.S. Pat. 3,166,910 discloses an apparatus for the control of a steam power plant. The invention relates to a system in which steam is taped from the turbine for preheating the feed water and two vessels are provided, one for cold water storage and one for hot water storage. At periods of low energy demand, cold water is drawn from the cold water tank and preheated by steam bled from the turbine. During this period, hot water is stored in the hot water tank. To be efficient, such hot water must be stored under pressure or else temperatures of only up to about 99° C can be utilized. When power demands are high, the cold water flow is stopped, no steam is bled from the turbine and hot water is fouling from the hot water tank as feed water. The hot water is not utilized to preheat feed water but is itself used as the hot feed water.

U.S. Pat. No. 3,129,564 deals with forced flow steam generating plants including a reheat apparatus. This system features a storage unit which accumulates hot water during periods of low power demand and feeds out such water as preheated boiler feed water during periods of high power demand. During peak demand, no steam is drawn from the turbine and the accumulated hot water is used as feed water itself and not as feed water heating material. During low demand, steam is used to preheat BFW (boiler feed water) and hot water is stored to meet anticipated demands.

It is clear from all of the above, that efficient energy storage can be achieved only at high pressure. Storage costs skyrocket when pressure is required. 500° F water means 700 PSI pressure, an unecomonical situation if storage of large quantities of potential power is desired. Storing hot water under pressure in underground caverns, which subterranean storage system is being considered as a means of pressurized storage of air, is fraught with problems such as dissolution of minerals and foulding of heat exchangers and machinery.

U.S. Pat. No. 3,886,749 to Pacault, teaches a steam power station which utilizes an accumulator for storing heat drawn from the operating steam cycle during slack operating periods when power demand is down and restoring said stored heat to the system during peak operating periods. The stored heat may be returned to the system through the stratagem of preheating boiler feed water and interstage steam reheat.

Examination of this patent however, draws to attention the fact that the key heat storage apparatus is an accumulator which features a static, nonmoving heat storage material, be it refractory material or stored heat carrier liquid, which static stored material is heated by means of a flowing heat transfer fluid. The process clearly indicates that the heat transfer fluid circulates and picks up heat from the turbines and stores this heat in a large volume of nonmobile heat retention material in the accumulator.

By way of comparison, the instant invention utilizes a stored heat retention material but said material is mobile, that is, moving from a storage location to a cold storage location. Such moving of low vapor pressure thermal energy heat retention material exhibits the distinct advantage over nonmoving heat retention material system (accumulator) in that by moving the LVP material the boiler feed water being heated is continuously being contacted with full temperature LVp material for as long as there is material stored in the high temperature tank. This means that for the entire period of peak power demand, or for as long as there is stored material in the hot tank, the BFW will contact uniformly hot material and will therefore be heated to a uniformly high temperture, i.e. the last unit of BFW heated will be heated to the same high temperature as the first unit of BFW so heated. By comparison, in a fixed bed thermal accumulator, heat can be stored by passage of a hot thermal energy carrier fluid. On flowing from one end to the other of said accumulator, the fluid will give up heat by thermal conduction to the solid tiles or paticles which make up the bed, resulting in a temperature front advancing along the bed in the direction of flow. Behind this front, the temperature of the solid will be close to the temperature of the entering hot fluid. Ahead of this front the temperature of the solid and fluid will be essentially that of the packing when the operating started. The width of te front (length of bed over which the temperature changes from hot fluid to cold packing) is a function of many parameters including tht capacities and heat transfer properties, fluid flow rate, bed and particle diameter, etc. Also, the regularity or evenness of the front is very much a function of flow distribution, channeling flow rates, etc.

The same holds true when the bed is hot and the entering fluid is cold, except all temperature indications are reversed.

The net effect of using a fixed bed accumulator at initial temperature $T_a$ on a fluid flowing through it with initial temperature $T_b$ is that the fluid will leave the accumulator with temperature close to $T_a$ for a period of time set by the time required for the above temperature front to advance through the length of the accumulator. This time is strictly a function of the heat capacity of the flowing fluid vs. the heat capacity of the total accumulator packing.

When the front of the temperature front "breakthrough" reaches the end of the accumulator, the temperature of the fluid leaving the accumulator will slowly change from close to $T_a$ to close to $T_b$. The ratio of the length of time over which the effluent fluid is at more or less constant temperature $T_a$ to the length of the varying temperature period is a measure of the inefficiency of the solid accumulator method of storing heat. Due to slow heat transfer, poor liquid distribution and channeling and superimposed thermal convection currents, the ratio of constant/varying effluent temperature periods is not sufficiently high to make this a preferred method of storing heat.

Other disadvantages of storing heat in a solid accumulator is expansion and contraction of the solid resulting in stresses and breakage, formation of fines which foul exchangers and the high cost of such devices. The specific heat of solids is usually much lower than that of liquids, resulting in a large weight and physical volume (allowing for voids) and corresponding interstitially held up liquid in these large containers.

The inefficiency of solid accumulators to store heat rather than storing the heat transfer fluid in two tanks (which means that the cold fluid is always cold and the hot fluid is always hot) is therefore: (a) the need for one additional heat transfer in and out of the solid, with the resultant 2 $\Delta T$ losses; (b) the inefficiences of channeling convection currents, slow heat exchange, etc. Which result in broad temperature fronts, i.e., variable temperature hot and cold streams for a good part of the cycle. These variable temperature streams are not desirable for normal plant operation.

U.S. Pat. No. 2,320,586 to Gilli describes an accumulator plant in which high pressure steam is stored in pressure vessels for eventual use as needed. The accumulators are charged at a higher pressure than the maximum boiler pressure. The stored high pressure steam is used to supplement primary boiler steam for driving the primary turbines. Once the pressure of the stored steam is below that of the boiler, the stored steam will be used to power secondary intermediate and low pressure turbines. In this patent, high cost, high strength pressure vessels are required. Furthermore, the stored material is not being used to heat boiler feed water not is the stored material an organic low vapor pressure heat retention material moving from a high temperature storage location means to a low temperature storage locations means (during periods of peak power demand).

U.S. Pat. No. 2,089,915 to Gilli stores high pressure hot water in multiple vessels. Such stored high pressure hot water is used to supplement the steam generated by the boiler to run the turbines. The hot water is stored at a pressure of 1700 pounds per square inch and allowed to drop in pressure to 300 lbs./sq. in. resulting in huge quantities of steam being produced.

U.S. Pat. No. 3,818,697 to Gilli discloses a complex arrangement of high pressure steam/water accumulators which are reduced in pressure and temperature by flashing, thereby generating turbine steam at different and varying pressures. The hot water is allowed to flash, the steam produced is used in a turbine and the condensate is returned to the accumulator, thereby reducing the temperature of all the material stored in said accumulator.

The patent also describes the use of a superheater, an accumulator which stores a hot material such as oil, diphenyl or terphenyl. These accumulators would function at low pressure. The stored "oil" would be permitted to flow in a closed system and is used only to superheat the steam generated by flashing of the stored high pressure water previously described. This patent, however, utilizes a closed loop whereby the oil would heat the steam and then, in a cooled state be returned to the accumulator vessel thus lowering the temperature of the entire volume of stored hot oil as the operation progresses.

By comparison, the instant invention stores hot low vapor pressure organic heat retention material ("oil" for short) in isolation from the cold "oil". The hot material is never degraded by mixing with expended "cold" material. Furthermore, the instant invention utilizes its stored heat to preheat boiler feed water and/or reheat interstage steam and/or generate steam to be fed into the turbines. The instant application discloses storing hot "oil" during periods of low power demand and restoring the heat so stored during periods of peak power demand by moving the hot material from a hot storage means to a cold storage means, with the hot material in the meantime producing hot BFW or reheating interstage steam or generating interstage power steam. Furthermore, since the hot and cold "oil" are not mixed during the course of use, the "hot" material retains its temperature until all of the material is utilized. Thermal degradation does not occur.

Canadian Patent 900,954 to Lawrence discloses the storage of the excess high level heat output of a power plant in alkali metal hydroxide tanks provided with a multitude of heat transfer coils. The alkali metal hydroxide are static in the accumulator tank with the heat transfer fluid (water) passing through the coils in this accumultor. Again, because of the continuous contacting of the entire mass of hot alkali metal hydroxide with cool heat transfer fluid, the system suffers from continuous temperature degradation. This system is also marked by the fact that the alkali metal hydroxide is heated during off hours by means of excess electrical energy and not by means of contact with various levels of primary and extraction steam.

U.S. Pat. No. 3,848,416 to Bundy teaches a system utilizing salt with a high, sharp melting point and high latent heat of fusion to store the excess high level heat of a nuclear reactor. This heat is withdrawn from the salt which is stored in a static accumulator by passing a suitable liquid medium (immiscible with the hot salt) through the hot salt in the accumulator and leading this suitable liquid medium (e.g. lead) to a boiler to generate steam. Again, this system suffers from the continuous degradation of heat content due to the continuous withdrawal of heat from the entire mass of hot salt heat storage material.

U.S. Pat. No. 3,818,698 to Gilli again teaches stored high pressure steam and hot water under pressure. The stored steam is not used to heat boiler feed water or reheat interstage steam but used directly as turbine steam.

Marguerre and Marguerre, World Power Conference V/II, Madrid, June 1960 "The Application of Heat Storage in Nuclear and Conventional Power Stations," pgs. 4355–4375, discloses a complete energy storage system featuring the use of turbine extraction steam to preheat boiler feed water and a feed water accumulator. During periods of low power demand, hot water is stored in the feed water accumulator. During peak power demands, hot feed water is drawn from the accumulator (to be replaced in the accumulator by an equal volume of cold condensate). The stored hot water is not used to preheat boiler feed water. In a modified embodiment, stored hot water is permitted to flash in special vessels so as to generate steam which steam is used to power an auxiliary turbine. These two above concepts are finally disclosed in an integrated system wherein both stored boiler feed water and steam flashing to power an auxiliary turbine are practiced. Mere superficial perusal indicates that the system disclosed is one in which the stored material is not functioning as boiler feed water preheat material but is itself boiler feed water. Furthermore, for the stored material to achieve and maintain a useful temperature, it will be necessary to utilize high strength pressure vessels.

Littler, D. J. Unipede Report on "Electrical Energy Storage," IERE Meeting, Tokyo, May 14 –19, 1975 describes numerous energy storage schemes, the one of primary interest in this instance being heat storage in the form of hot water, preferably flashed to steam rather than steam storage. In two variations on the main theme of heat storage, Littler describes storage of hot water, which will be used during peak demand periods as boiler feed water and as variation No. 2 the flashing of stored pressurized hot water to generate steam for use in auxiliary turbines. Littler states that a variant of hot water storage is to store a secondary fluid rather than water, but does not describe any embodiment, nor does he indicate if any embodiment indeed exists, other than for the off-handed aside. As presented and lacking further clarification, this falls into the category of Gilli and cannot be read as disclosing the concept of the instant invention.

Where a multi-stage steam turbine receives a given amount of high pressure steam, maximum power is obtained from this steam when all the steam is allowed to expand through all the turbine stages and is condensed at the "thermal sink" temperature in the condenser. However, the boiler then has to both preheat the cold boiler feed water and evaporate the hot water at boiler pressure and temperature, and this is a waste of high level heat. It is much more economical to extract varying amounts of interstage intermediate pressure steam streams from the turbines in amounts and at pressure levels commensurate with the boiler feed water preheat requirements. In this way, various streams which have already done some work in the high pressure stages of the turbine are used to preheat the boiler feed water gradually, and for each Btu of intermediate pressure steam used for this preheat service (after some work was obtained from it) a Btu of high level heat in the boiler is freed from preheat service and made available to generate high pressure steam for the turbine. Consequently, maximum power from a given capacity boiler plus turbine can be obtained if judicious amounts of intermediate pressure steam streams are extracted from between the various stages of the turbine and used for boiler feed water preheat. The exact levels of pressure and temperature, and the amounts of such streams, may vary from about 2–10% of the total steam at each extraction point and are at the discretion of the designers.

Generally, the high temperature, high pressure steam coming directly from the boiler is not used for boiler feed water preheat since there is no advantage in such a "bootstrap" operation. High level heat would be used, before any work was extracted from it, to save high level heat. However, some of this high pressure steam is used for the purpose of reheating intermediate pressure turbine interstage steam. This in effect, superheats this intermediate pressure steam so as to minimize the degree of condensation occurring in the turbine during the subsequent adiabatic expansion.

The instant invention makes use of the above principles, regarding high pressure steam extraction, steam boiler feed water preheat and interstage steam reheat to allow storage of heat to the maximum extent and use of this stored heat at the appropriate time to maximize the power output from given plant.

In Ser. No. 533,263 filed Nov. 11, 1974, in the names of Cahn and Nicholson, herein incorporated by reference, it has been disclosed that thermal energy can be stored in a LVP (low vapor pressure) organic material by transfer of heat directly from extraction steam and/or primary high pressure steam to the LVP organic material. The hot LVP organic material is stored in a high temperature storage location means. Maximum LVP organic material heating occurs at night or during periods of low power demand while during peak demand periods, BFW preheat and interstage steam reheat chores are done by moving the hot organic material from the high temperature storage means to a low temperature storage means in the process contacting boiler feed water with the hot LVP organic heat retention material at heat exchanger means, so that extraction steam withdrawal and withdrawal of primary high pressure steam can be reduced or terminated.

The instant invention dramatically simplifies the above concept and reduces the dangers present when high pressure steam and extraction steam are used to heat an LVP organic material within the confines of the power plant and when such hot LVP organic material is stored in the vicinity of the power house. The instant invention also eliminates the problems which are faced when steam is used to heat an LVP organic material at any distance from the power house, such problems being multiplicity of steam and condensate lines, steam line designs, wet steam metering, pressure drop and quality control problems.

The instant invention overcomes these difficulties and allows a reasonably distant oil storage site to operate very effectively in conjunction with a utility powerhouse. This advantage is achieved by using hot water, that is, a portion of the hot boiler feed water stream itself, as reheating medium for the LVP organic material.

Water from the condensers is fed to BFW heating means which heating means utilize extraction steam from the turbines. These heating means are sized roughly twice as large as in plants without the LVP organic material heat retention systems. At night, or during periods of low power demand, such heating means units can preheat about twice the normal amount of BFW using about twice the normal amount of high pressure and extraction steam. The normal amount of BFW is fed to the boiler while the additional hot water is sent to water-oil heat exchanger means whereat the LVP organic material moving from cold storage location means at a temperature of about 190° F. to high temperature storage location means, is reheated preferably to a temperature of from 450°–600° F. The BFW lines designed to handle double the amount of BFW can be either two independent lines or one large high pressure line. The "cold" water (~210° F) from the LVP organic material reheat exchanger means is returned to the BFW reheat line where it joins cold condensate for reheating through the steam-water heating means or alternatively the expended BFW which has been used to preheat LVP organic material (now at a temperature of about 210° F) is stored in separate storage means for use as BFW during peak demand periods.

In a variation on the above concept, the hot boiler feed water used to heat the LVP organic material may be drawn from the BFW line at locations of varying temperature and pressure, sent by transporting means, for example, a conduit, to heat exchanger means whereat the LVP organic material moving from a low temperature storage location means to a high temperature storage location means, picks up thermal energy and the now partially cooled water is returned by another transporting means to the BFW line at a point of lower temperature and pressure than the point at which said stream was drawn off.

During peak demand periods, BFW preheating in the steam-water heating may be essentially terminated. However, it may actually be advantageous to continue withdrawing extraction steam out of the turbine at the lowest pressure extraction stages in order to heat the cold condensate (i.e., Boiler feed water) somewhat, even during peak periods. The amount of power which can be effectively stored at the low temperature levels of this low pressure steam, in the range of 130°–175° F is very small, while the exchanger means required to achieve good temperature transfer and useful heat levels with materials which have high viscosity when cold are high. Cold BFW (or BFW from a 210° F storage means) is heated through contacting with hot LVP organic material, which is moving from high temperature storage location means to low temperature storage location means. Such heating is performed either in separate exchanger means or preferably in the same exchanger means wherein cold LVP organic material moving from cold to hot storage means was initially heated by hot BFW, the heating of the BFW being done simply by reversing the flows of the water and LVP organic material. The exchanger means function as both oil heater meanswater cooler means (during off hours) and oil cooler meanswater heater means (during peak demand).

Preheated BFW is taken from the last water heater means and sent to the boiler. For the system to work efficiently, it is necessary that extra large steam-water heating means be available since effectively twice the quantity of BFW is produced during off-hours.

The instant system has the advantage over prior systems in that a limited number of interconnection means exist between the power plant and the storage plant and all connections are water transporting means (i.e., lines). Further, the number and type of heat exchanger means are simplified from units which can alternate between steam-oil and water-oil service to units only performing water-oil service and this alteration of the exchanger means type is what facilitates exchanger means simplification since now heater function can be changed merely by reversing material flow. Furthermore, since water is easier to transmit over a distance that wet steam, such an energy storage facility can now be located at a distance from the powerhouse, and it is possible that such a facility can be shared by a number of power plants, thereby resulting in substantial savings over individual in-plant energy storage facilities.

As previously mentioned, it is also possible to utilize stored hot water as BFW. This hot water at 210° F can be either the water used to initially heat the LVP organic material or it can be water specifically heated by low pressure extraction steam and stored for eventual use. This hot water stored at atmospheric pressure is used as BFW and fed either by itself or mixed with cold condensate to the hot LVP organic material heat exchanger means for heating to optimum BFW temperature. By using stored hot water at about 210° F, it is possible to reduce the amount of heat exchanger means heating area required to achieve a given BFW temperature. Such savings, however, are obtained at the cost of providing hot and cold water storage means. The advantage, however, is achieved by reduced and simpler exchanger designs and oil handling requirements.

The fraction of the power output of a thermal generating station which can be stored in a heat storage medium is very much a function of the temperature level at which the heat is stored and at which it is subsequently utilized in the power generating thermodynamic cycle. The level at which it is used in the thermodynamic cycle must always be somewhat lower than the temperature at which it is stored, which in turn is somewhat lower than the temperature level at which it is drawn out of the primary cycle during off-peak periods (i,.e., during the heat storage cycle). The higher the ultimate utilization temperature level, the greater the fraction of the power output which can be stored, and also the higher is the storage efficiency, assuming a given original temperature level at which that increment of heat was drawn out of the primary cycle.

For example, 1000 lb/hr of steam at 1000 psia and 545° F or so can generate about 75 KW in a modern nuclear power plant. The same quantity of steam at 160 psia and 365° F only generates 35 -45 KW of power. While the quantity of heat stored is roughly the same, the achievable power output is less. Therefore, it is desirable to store as much high level heat as possible, and to use it at as high a temperature level as possible. Heat which is stored at 500–550° F should be used at that level and not degraded to 350°–400° F heat by injecting it into the power plant cycle, as this will lose 40% or so of the recoverable power.

At the same time, it is desirable to maximize the temperature range between the hot oil and the "cold" oil, i.e., to maximize the energy which is stored and recoverable per unit volume of LVP organic material. Therefore, it would not be economical to store and use heat just at the 500°–550° F level and not utilize the potentially recoverable energy in the 200°–500° F temperature range in the stored oil. Conversely, if BFW preheat requirements for a certain powerhouse cycle only require temperature levels of 200°–450° F for the stored LVP organic material, since BFW temperature is limited to say, 420° F, there is a real incentive to extend the temperature range of the stored LVP material upwards into the range of 500°–600° F and to use it at that level in the powerhouse cycle so as to extend and increase the amount of heating which may be done and to increase the fraction of the powerhouse capacity which can be stored in the LVP material.

As previously explained, using this 450°–550° F or 450°–600° F heat to assist in the BFW preheat to the 420° F level is feasible but not very desirable in view of the efficiency loss. Generating some medium pressure steam with this heat is possible, but will result in some efficiency loss due to the high latent heat requirements of steam generation. However, this alternate is an attractive alternate if maximizing the fraction of power to be stored is a goal at the expense of efficiency.

In a particularly attractive alternate embodiment, BFW is heated during low power demand periods to super hot temperatures, well in excess of boiler requirements. Some, as previously described is sent to LVP organic material heater means to heat the LVP organic material. The other fraction is used to reheat interstage steam, thereby being cooled sufficiently to function as BFW. During peak demand periods, BFW preheat chores are carried out using hot LVP organic material moving from high temperature storage means to low temperature storage means. The BFW either directly from the condenser of from hot water storage means or both, is heated to super high temperatures by the moving LVP organic material at oil-water-heat exchanger means. This superheated BFW is first used to reheat interstage steam and then used in its cooled state as boiler feed water. Such a scheme maximizes the energy storage in the LVP organic material, and enables boilers using feed water at about 420° F to take advantage of the BFW high temperature attainable with hot LVP organic material without wasting that portion storable between about 440° F to 520°–550° F. The cooling necessary to utilize 500°–550° F BFW in a 420° F boiler is achieved by sending the hot BFW stream through the interstage steam reheater means exactly as was done with 500°–550° F BFW from the high pressure steam and extraction steam heater means during off peak hours when heating is done not by moving hot LVP organic material but by extraction and primary high pressure steam.

It is clear that this method of utilizing the higher temperature range of the thermal energy stored in the LVP organic material is applicable regardless of the method by which the LVP organic material is heated during off-peak hours. Thus, this heating of the LVP organic material can be done via the hot water loop-method disclosed herein or via the direct high pressure and extraction steam heating of copending Ser. No. 533,263, or any other means and the hot LVP organic material so obtained can be stored in a high temperature storage means for use during peak demand periods to preheat boiler feed water and by generating super hot boiler feed water used, such super hot water to reheat interstage steam before being used in a cooled state as BFW.

In the practice of this invention, the heat storage medium is described as a low vapor pressure organic heat retention medium. Such an LVP is a hydrocarbon oil, preferably derived from petroleum by distillation and refined, if necessary by catalytic treatment for the hydrogenation of unsaturates and/or for the removal of sulfur (and nitrogen) in the presence of hydrogen under pressure utilizing any of the standard catalysts known in the art such as cobalt molybdate, nickel-molybdenum, etc. The hydrocarbon distillate can also be treated by means of solvent extraction to remove unstable, easily oxidized compound which could lead to sludge and deposit formations on hot heat exchanger means surfaces. The material can also be dewaxed by use of the appropriate low-temperature crystallization/-separation techniques known in the art to improve the low temperature handleability (i.e., viscosity and fluidity) of the oil. Before being treated as described above, the hydrocarbon distillate can be thermally and/or catalytically cracked to remove any thermally unstable material present but such cracking should be followed by hydrogenation to remove any unsaturates resulting from the cracking.

The hydrocarbon distillate used should be the fraction within the boiling range of 5° to 1300° F, preferably 600° to 1100° F and most preferably 650° to 1000° F. The vapor pressure of the material used for such thermal energy storage should not exceed 1 atm at the maximum utilized storage temperature and should preferably be below 0.25 atm and most preferably, below 0.1 atm. This is preferred since low vapor pressures facilitate the use of unpressurized storage means and storage systems which do not require special high pressure construction are naturally more economical, durable and more easily maintained. Such materials of low vapor pressure may be kept in isolation from the atmosphere, so as to avoid material degradation, by means of an inert gas atmosphere blanketing the stored material, and may include the use of an insulated floating roof or diaphragm-type apparatus over the stored material. The higher the vapor pressure, or even the closer the pressure gets to 1 atm. problems arise in systems isolation and materials handling. Inert gas transfer and balance between hot and cold storage means becomes a problem when the organic material has a vapor pressure approaching or exceeding 1 atm. at the storage temperature.

Typical materials which qualify as low vapor pressure organic heat retention materials are exemplified but cannot be viewed as exhaustively disclosed by the following:

Vacuum gas oil obtained from crude 650° F VT atmosphere pipestill bottoms by running in a vacuum pipestill, getting a 650°/1050° F VT cut, followed by hydrodesulferization over a catalyst in the presence of $H_2$ under pressure;

The vacuum gas oil described above further treated by solvent extraction to remove unsaturates, sulfur and nitrogen compounds and aromatics;

Catalytic cracking cycle stock with a boiling range of from about 600° to 950° F drawn from a recycle catalytic cracker followed by hydrotreating. The feed to the catalytic cracker, which is usually a meterial with a boiling range of from 500° to 900° F, may but does not necessarily have to have been hydrotreated for sulfur removal prior to cracking;

Thermally cracked gas oil, i.e., steam cracked gas oil in the 600° to 1000° F boiling range after appropriate catalytic hydrotreating to saturate olefins and diolefins and to decrease sulfur and nitrogen content;

Doubly extracted and dewaxed 600° to 1000° F VT vacuum pipestill fraction, suitably hydrotreated (hydrofined) for example, Caloria HT-43, a commercial heat transfer oil, produced by Exxon, which is produced from a lube vacuum feedstock;

600° to 900° FVT fraction obtained from hydrocracking, a process in which heavy gas oils are catalytically broken down and hydrogenated over a catalyst in one or more steps;

600° to 900° FVT coker gas oil suitably stabilized by catalytic hydrogenation.

The sulfur levels in the feeds considered may range, prior to hydrogen treatment, from 0.3 to 5.0% and should be of the order of 0.05 to 1% following hydrogenation.

Oxidation stability additives and sludge dispersants and depressants may be added to the product to improve its performance in the hot LVP thermal energy retention material (i.e., oil) storage plants. Typical anti-oxidants are hindered phenols, such as t-butyl phenol and typical dispersants may be sulfonates or ashless dispersants based adducts. The content of the anti-oxidants and dispersants in the oil would preferably be below 1% each.

A better understanding of the invention can be gained by reference to the accompanying figures. It must be understood that the systems outlined in the figures are merely offered for the sake of clarifying the invention and are not intended to be taken as an absolute representation of every possible modification and variation to the basic concepts which can be made by those skilled in the art.

Figure 1:
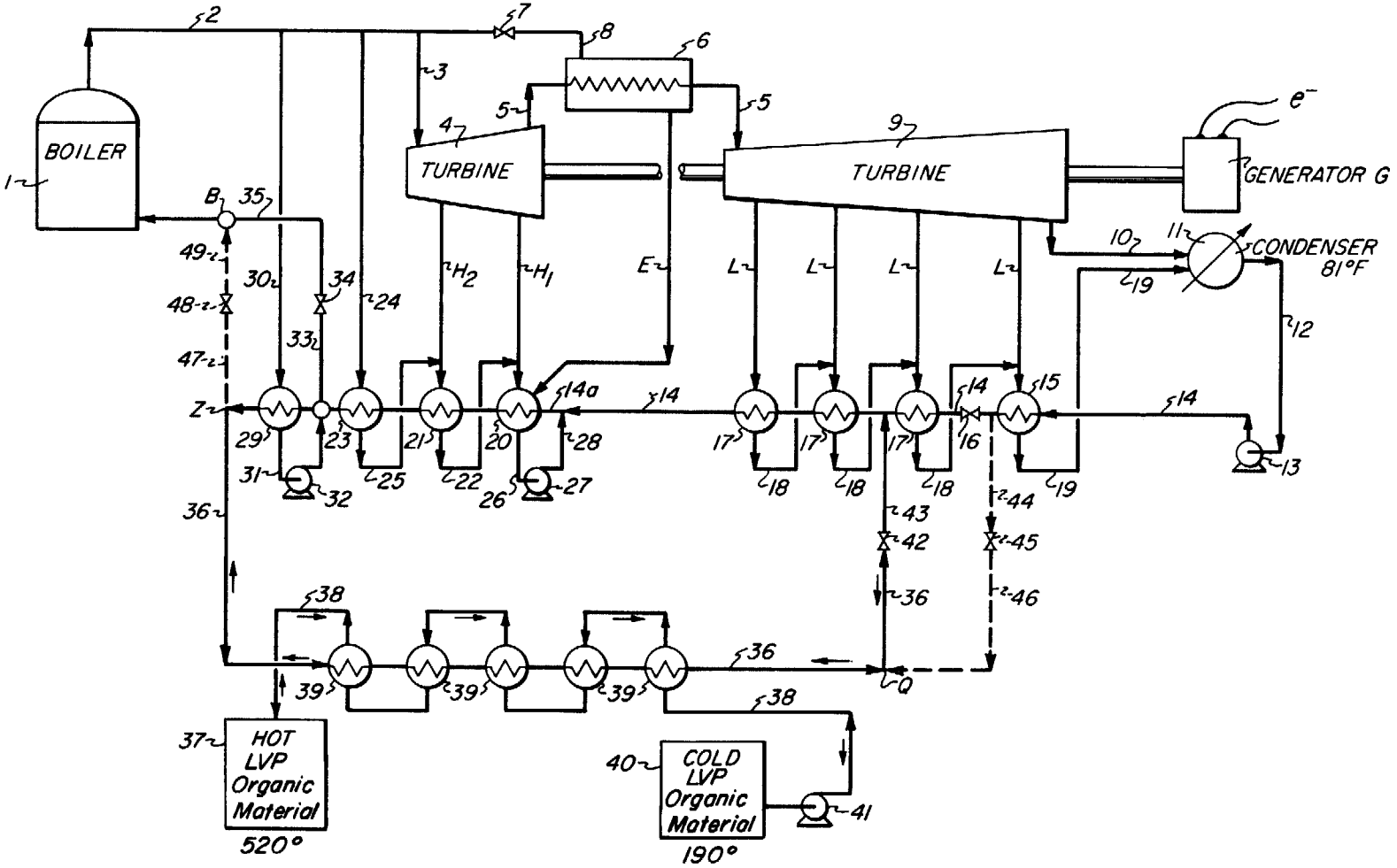
FIG. 1 represents a simple system utilizing hot BFW as heating medium for the LVP organic material.

FIG. 1 — High pressure steam comes from the nuclear reactor or constant output fossil fuel furnace and boiler 1 and passes through conduit 2. Conduit 3 draws a major portion of the steam off from conduit 2 and feeds this steam to turbine 4. Another portion of the primary high pressure steam passes through valve 7 to conduit 8 which leads the steam to interstage steam reheat unit 6. Interstage steam from turbine 4 passes by means of conduit 5 through unit 6 where it is reheated before being fed to turbine 9. Spent steam from turbine 9 passes through conduit 10 to condenser 11. Condensate from 11 passes through conduit 12 to pump 13 and thence to conduit 14. Conduit 14 introduces the water to water-steam heat exchanger 15 which exchanger is heated by extraction steam taken from turbine 9 through line L and which exchanger also receives condensate from exchangers 17 (which are fed by lines L from turbine 9) through conduit 18. Condensate from exchangers 17 and 15 passes through conduit 19 to condenser 11.

The boiler feed water in conduit 14 which has been heated in exchanger 15, passes through valve 16, which valve is open during periods of low power demand, while valve 45 in conduit 44 is closed. The BFW continues on its passage through conduit 14 and is continuously heated by contacting with numerous steam-water heat exchangers 17 of ever increasing temperature which exchangers are fed by steam extraction lines L and which exchangers cascade condensate into each other from high temperature to ever decreasing temperatures through conduit 18.

The substantially warm BFW in now conduit **14*a* continues its journey and is contacted with ever increasing temperature heat exchangers 20, 21 and 23 which are fed respectively, by line E with condensate from interstage steam reheat unit 6, by extraction steam from turbine 4 through lines $H_1$ and $H_2$ ($H_1$ also feeding into exchanger 20) and by line 24 feeding primary high temperature steam to the exchanger 23. The condensate of these exchangers is also passed down in cascade fashion through lines 25, 22 and 26. Conduit 26 leads to pump 27 which feeds hot water to conduit 28 which empties into conduit 14. At this point, conduit 14 becomes conduit 14*a*. Conduit 14*a* is a line of increased volume capacity, pressure and temperature tolerance or may alternatively be composed of two or more standard conduits running in parallel. BFW in conduit 14*a* receives a final thermal boost in exchanger 29 fed through line 30 with primary high pressure steam. At junction Z, conduit 14*a* divides into conduit 36 and 47. During periods of low power demand, approximately one half of the BFW proceeds through exchanger 29 to conduit 36 at Z. The condensate from 29 passes through line 31, pump 32 to line 33. Line 33 joins with line 14*a* and becomes the BFW line 35 leading to Boiler 1**.

Valve 48 on line 47 is closed forcing one half of the hot BFW in **14*a* to pass through line 35 through open regulating valve 34 into Boiler 1. The portion of BFW in line 36 is used to heat LVP thermal energy retention material (such as oil). Cold oil from tank 40 is pumped by reversible pump 41 (which may be placed anywhere on line 38) to line 38 and through oil-water heat exchangers 39 to hot oil storage tank 37. The now cooled BFW in conduit 36 passes through valve 42 to line 43 and is reintroduced to the BFW stream of conduit 14** to begin the process again.

During periods of high power demand valve 16 is closed, shutting down flow in line 14 and **14*a* except for some exchanger and turbine condensates and, thereby terminating or sharply reducing withdrawal of extraction steam from turbines 9 and 4 to exchangers 17, 20 and 21 through lines L, $H_1$ and $H_2$. Withdrawal of primary high pressure steam through line 24 to exchanger 23 is also stopped or sharply curtailed. Exchanger 29 will be idle. Thus all steam extraction lines are essentially closed allowing BFW preheat duties to be done by hot oil stored and moving from high temperature to low temperature storage means and allowing the steam generated by Boiler 1 and fed to the turbine, fully expend itself in the turbines. Valve 42 on line 36 is closed and valve 45 on line 44 is opened allowing cool BFW from line 14 to pass through line 46 to junction Q where line 46 becomes line 36 which now functions as BFW preheat line and the BFW picks up thermal energy in exchangers 39 by means of hot LVP material being pumped from tank 37 to tank 40. The hot BFW in line 36 flows into line 47 at junction Z. Valve 48 is open while valve 34 in line 35 is closed thereby forcing flow through line 47. BFW passes through line 47, valve 48 to line 49 where it empties into the main BFW conduit 35 leading to Boiler 1**.

Figure 2:
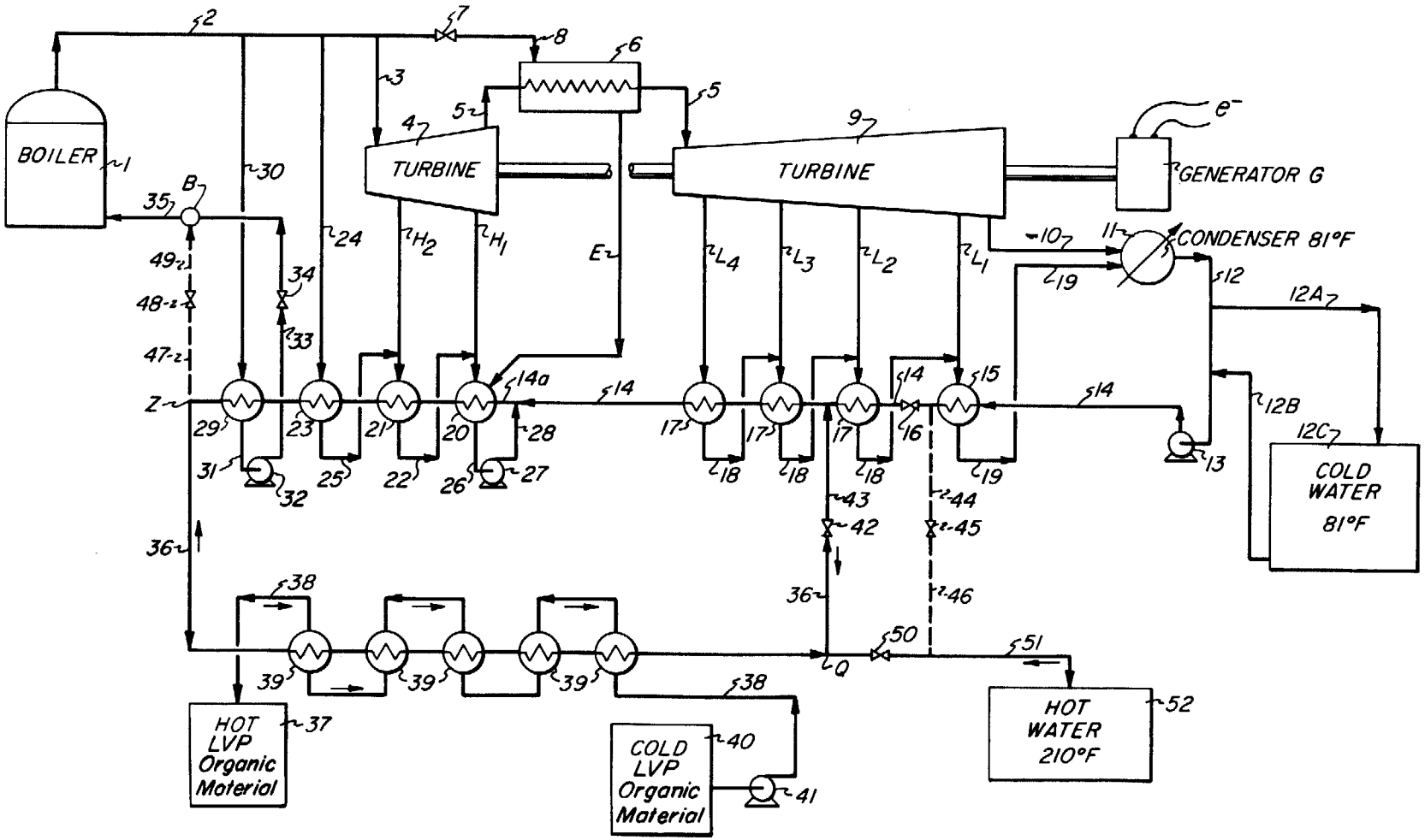
FIG. 2 represents a system utilizing stored 210° F water as BFW which is fed to heater means which are heated by moving hot LVP organic material from high to low temperature storage means.

FIG. 2 is a variation on the theme of FIG. 1. During periods of low power demand, BFW is drawn from condenser 11 and from the cold water tank **12*c* and introduced to line 12 through 12*b*. Thereafter, the standard operation is performed on the water in line 14 and 14*a* as described for FIG. 1. Once the BFW has expended itself in heating the oil, however, one of two alternatives can be practiced with the still relatively hot water. Valve 42 can be closed and valve 50 opened causing hot water to flow through line 51 to hot water storage tank 52. Alternatively valves 42 can be open and 50 closed allowing the BFW to recirculate. The hot water tank 52 can be filled in this alternative by use of line 44, valve 45, tapping line 14 just after the BFW water has received a small measure of thermal energy in exchanger 15**.

During peak demand periods, tank **12*c* is empty. Valve 42 is closed and so is valve 16, shutting down extraction steam lines L, $H_1$ and $H_2$ and primary lines 24 and 30. Water is forced to flow from hot water storage tank 52 through line 51 through open valve 50 through junction Q to line 36 where the procedures as described for FIG. 1 begins. Rather than have the water circulate, however, spent motive steam from turbine 9 passes through line 10 to condenser 11 and thence through line 12 to 12*a* for storage in cold water tank 12*c***.

Alternatively, rather than using stored hot water exclusively as the feed water, a portion of the fresh condensate from condenser 11 or a portion of the cold water from storage means **12*c* (which in this alternative may not be completely empty at peak demand period) can be heated partially with extraction steam (as in exchanger 15 and that portion led through line 44, open valve 45 and line 46 for blending with stored hot water from storage means 52 in line 51**.

Figure 3:
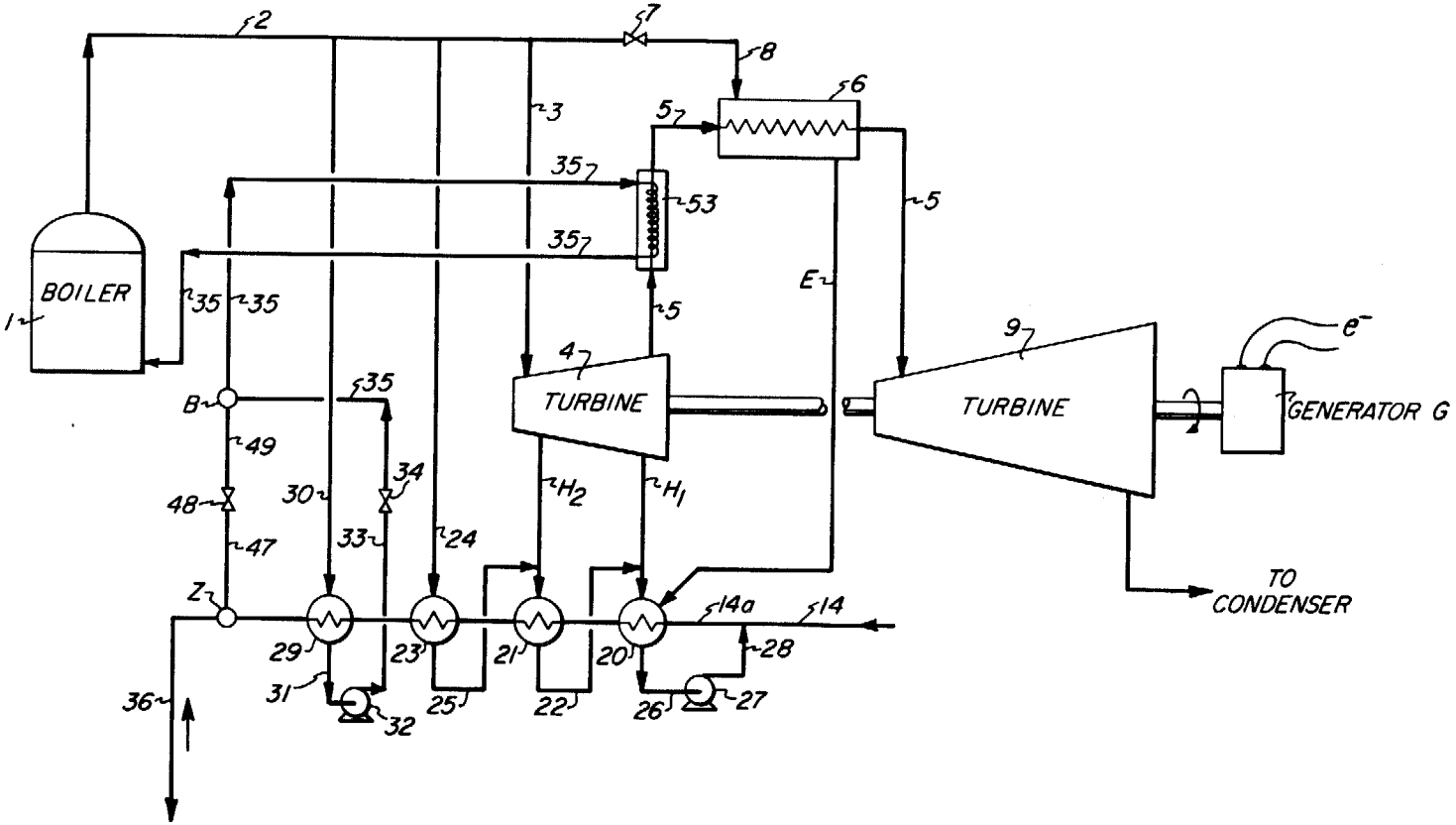
FIG. 3 represents a system utilizing 520°–550° F BFW in a boiler limited to 420° F BFW temperature by using the superhot BFW initially as interstage steam heater material.

FIG. 3 describes a method for allowing maximum use of high temperature oil storage systems in boilers utilizing low temperature boiler feed water. The BFW in line 36, heated to maximum extent possible by hot LVP organic thermal energy heat retention material passes through junction Z to line 47 and open valve 48. Line 35 is closed by closing valve 34. Hot BFW passes through line 49 to junction B. From junction B, the hot BFW passes through line **35*a* to heat exchanger 53 wherein interstage steam from turbine 4 being led to turbine 9 through line 5 is reheated. During periods of low power demand, when BFW preheat is performed by use of extraction steam and primary high pressure steam, the hot BFW can pass through line 33 through open valve 34 to line 35 (conduit 47 is closed by valve 48) and the hot BFW is allowed to cool by expending itself partially in exhcangers 53 as interstage steam reheat material before continuing along line 35*b* to the Boiler 1**.

The heat contained in the superhot BFW is usually more than the sensible heat required for reheating the interstage steam. In order to balance the heat load and maximize the energy recoverable out of the stored thermal energy, a number of schemes can be employed. The simplest is to allow some of the moisture condensed out of the expanding steam in the high pressure turbine 4 and contained in the wet steam leaving that turbine via line 5, normally separated out before going to reheater 6, to remain in the reheater feed. Evaporation of this contained water and its conversion into intermediate pressure steam will easily balance the available heat in the superhot BFW over and above the temperature at which it can be fed to the boiler. Another scheme is to use the still hotter than desired BFW leaving the reheater to generate intermediate pressure steam which is used at the appropriate stage in the turbine. Alternatively, only the required amount of superhot BFW coming from the hot oil exchangers via line 36 is exchanged in reheater 6, while the remainder of the superhot BFW is utilized for intermediate pressure steam generation, either by indirect heat exchange, or by flashing.

It should be realized that the effective and efficient use of the superhot BFW for interstage steam reheat and additional intermediate pressure steam generation, if so desired, is not limited to the specific LVP organic material energy storage scheme disclosed in this application, but is equally applicable to the cases where the LVP material is heated directly with various pressure level extraction steams during the off-peak period. As a matter of fact, when power-house and oil storage facilities are closely coupled, intermediate pressure steam generation and BFW preheat can be carried out directly in the oil-water exchangers during the on-peak period, allowing intermediate pressure steam to be generated directly at BFW temperature by heat exchange with the stored hot oil, and led directly to the turbines and, at the same time preheating the BFW only to that temperature which is acceptable for the boiler and nuclear reactor. However, even when the power-house and oil storage facility are closely coupled, intermediate pressure steam reheat by the use of the above-described superhot BFW is a preferred scheme. This permits use of hot water in the steam superheater 53 both during off-peak and on-peak periods, thus avoiding the need to switch over heating means as well as the necessity to have two types of exchangers, one for oil vs interstage steam (for on-peak) and the other for high pressure steam vs interstage steam (for off-peak). Extensive valving of steam lines and doubling up of expensive heat exchanger equipment is thereby avoided. However, it should be noted that this scheme is only of value if the heat which can be stored in the LVP material is at a higher temperature level than can be advantageously and fully utilized by BFW preheating.

Figure 4:
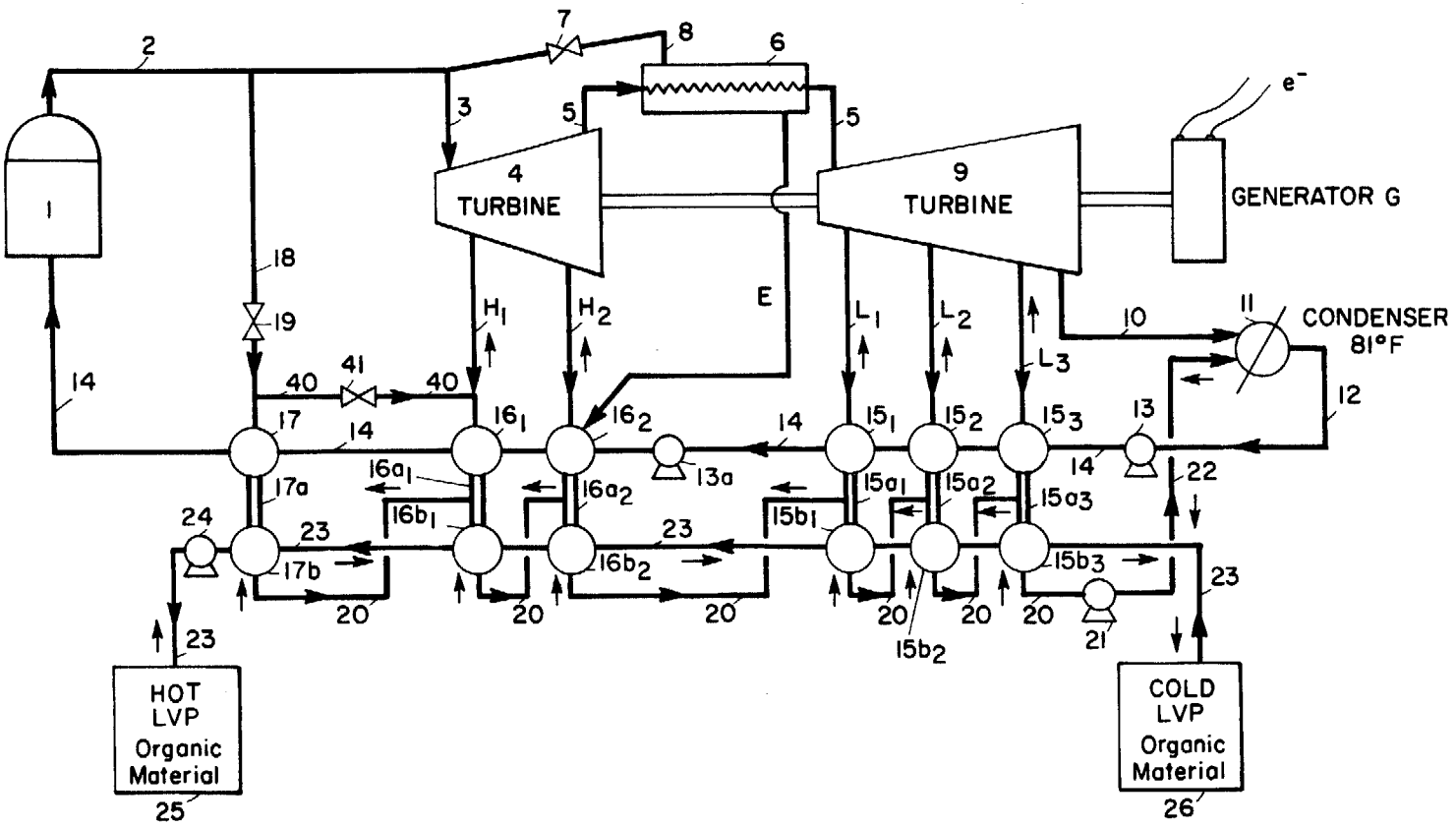
FIG. 4 represents a system which utilizes the moving hot LVP organic material to produce intermediate pressure steam for use directly in the turbines while also preheating BFW to a temperature satisfactory for use in the boiler.

FIG. 4 — High pressure steam comes from the boiler and is fed to the turbines, interstage steam reheat unit and eventually the condenser (unit 11) as previously described. Boiler feed water (BFW) from the condenser 11 travels through line 12 through pump 13 to line 14. Along line 14 the BFW is preheated by passing through heat exchangers $15_1$-$15_3$ fed with extraction steam from turbine 9 through lines $L_1$-$L_3$, through exchanges $16_1$ and $16_2$ fed with extraction steam from turbine 4 and condensate from interstage steam reheat unit 6 through lines $H_1$ and $H_2$ and E and through exchanger 17 fed with primary high pressure steam through line 18 and open valve 19 from line 2. Line 40 is closed at this time by closing valve 41. This preheated BFW proceeds through line 14 to Boiler 1. During periods of low power demand, the primary high pressure steam and extraction steam are used to reheat low vapor pressure (LVP) organic material. Cold LVP organic material from vessel 26 passing through line 23 passes through heat exchangers $15_{B_1}$ - $15_{B_3}$ . These exchanges are heated by means of extraction steam from turbine 9 which steam is also used in parallel or series to preheat BFW in exchangers $15_1$-$15_3$. This extraction steam passes through lines $15_{a_1}$ - $15_{a_3}$ to exchangers $15_{B_1}$ - $15_{B_3}$ and the respective condensates through cascade lines 20 through pump 21 (reversible) to line 22 and thence to the condenser 11. The warmed LVP organic material continues through above line 23 to heat exchangers $16_{B_1} + 16_{B_2}$ which exchangers are heated by means of extraction steam from turbine 4 which steam is also used to preheat BFW at exchangers $16_1$-$16_2$ as described above. The extraction steam passes from the respective turbine extraction points and exchangers $16_1 + 16_2$ through lines $16_{a_1}$ - $16_{a_2}$ to exchangers $16_{B_1}$ - $16_{B_2}$ wherein thermal energy is transferred to the LVP material in line 23. The steam condensate proceeds in cascade fashion through lines 20 and finally arrives at condenser 11. The LVP organic material in line 23 receives a final thermal boost to exchanger $17_B$ wherein primary high pressure steam which also heats BFW in exchanger 17 passes through line **17*a* from exchanger 17 or from value 19 to exchanger $17_B$ thereby heating the LVP material in the process. The spent primary high pressure steam condensate proceeds via cascade lines 20 to condenser 11 or to line 14 as feed to the boiler while the now hot LVP organic material in line 23 passes through reversible pump 24 for storage in vessel 25. This pump may be placed anywhere in line 23**.

During periods of peak energy demand water is drawn from condenser 11 through lines 15 via pump 13 and line 22 through pump 21, then via lines 20 through heat exchangers 17B, $16_B$ -$16_B$ and $15_B$ -$15_B$ . Several pumps not shown, may be required to direct the water through these exchangers in the direction of increasing temperature and pressure. Hot LVP organic material from vessel 25 passing through line 23 and pump 24 on its way to vessel 26, is used to heat the water in the B series exchangers. The water is heated to such a degree that it becomes steam in the B series exchangers. This steam is sent through the A series lines to exchangers $17_1$, $16_1 + 16_2$ and $15_1$-$15_3$ wherein BFW from condenser 11 passing through line 14 is heated before introduction into the boiler 1.

Once the requirements of BFW preheat have been met; however, there may be an excess of steam generated in the B series exchangers, depending on the rate at which hot oil is pumped through its exchangers. This excess steam can be therefore, taken via lines $H_1$ and $H_2$ and $L_1$-$L_3$ and injected into the turbines. In this way, the hot LVP organic material is used to both preheat BFW and generate intermediate pressure steam at the optimum available temperature levels for use directly in the turbines. Obviously, by using this system, extraction steam draw-off is reduced, or completely terminated allowing the steam in the turbine to totally expend itself in the production of power. Furthermore, excess steam over and above BFW preheat requirement produced by use of the LVP organic material joins with and, therefore, increases the amount of steam in the turbines thereby increasing the amount of power generated. This excess steam can also be used to drive a separate turbine. It should be noted that in the scheme of FIG. 4, the steam generated in exchanger 17B does not back up via line 18 into the primary high pressure steam line 2, but by closing value 19 and opening valve 41, the steam is allowed to flow through line 40 into the H series lines and thereby into the turbines.

Figure 5:
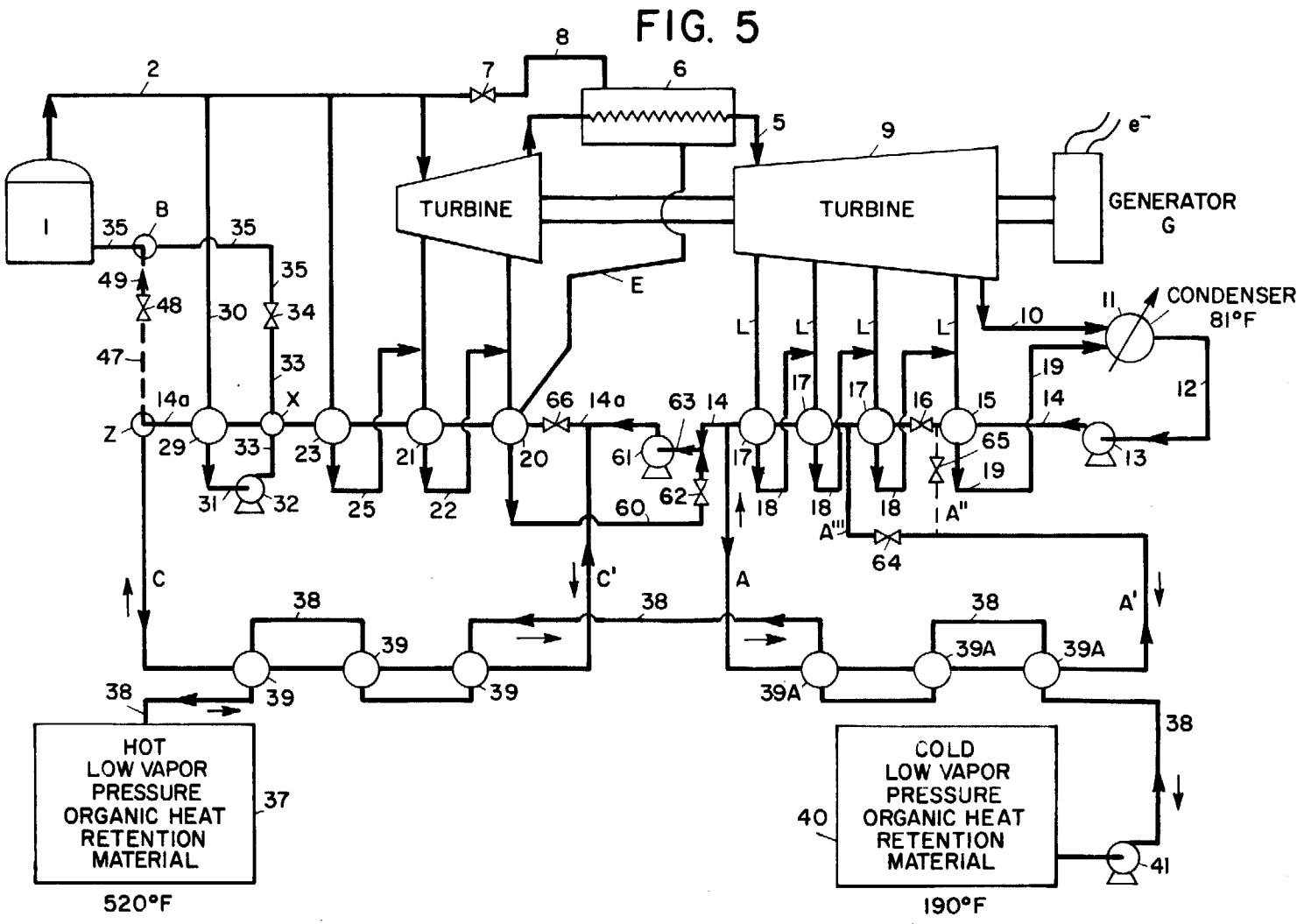
FIG. 5 represents a system where hot BFW is used at two different pressures and over two different temperature intervals as heating medium for the LVP organic material.

FIG. 5 — During periods of low power demand, excess boiler feed water is preheated by means of turbine extraction steam and primary high pressure steam. In this scheme there are two conduit means channeling the excess BFW to the oil-water heat exchanger means. Line A coming off of conduit 14 is a low pressure, low temperature line which conducts the excess boiler feed water preheated by means of low level extraction steam taken from the low pressure turbine. Line A transfers its energy to the low vapor pressure thermal energy retention material moving between storage means 40 (cold storage) to 37 (hot storage) through line 38 by coming into heat exchange relationship with the moving material in heat exchanger means 39A. Once the moderately hot excess BFW has transferred into energy, it returns to the main BFW preheat line 14 by way of conduit $A^{11}$. Valve 65 is closed, thereby closing line $A^{11}$. Valve 64 is open allowing the BFW to pass through conduit $A^{111}$ to line 14. High temperature-high pressure excess BFW heated by high level turbine extraction steam from the high pressure turbine and primary high pressure steam directly from the boiler (via line 30 and 24 leading to the appropriate heat exchanger) is led via conduit C to further heat the partially reheated LVP material in line 38 by coming into heat transfer relationship with said LVP material in heat exchanger means 39. Once the hot excess BFW has transferred its energy to the moving LVP material, it returns to the main BFW preheat line 14a via line $C^1$ to repeat the procedure of preheating as BFW.

During periods of high power demand, all of the preheating of BFW may be performed by use of moving hot LVP thermal energy retention materials from storage means 37 to storage means 41 through conduit 38 and contacting in heat exchange relationship, cold BFW in the appropriate heat exchanger means units.

During peak demand periods valve 16 is closed thereby closing line 14, forcing the BFW from condenser 11 which has been partially preheated in exchanger 15 to proceed through open valve 65 to conduit $A^{11}$, valve 64 is closed preventing BFW from traveling through conduit $A^{111}$ to preheat line 14, which leads into conduit $A^1$ which in turn brings the cool BFW into heat exchanger relationship with hot LVP material in heat exchanger means 39A. This LVP is of reduced heat content having already given up heat in exchanger means 39 (to be described below). The now partially heated BFW proceeds via line A into the latter portion of feed water line 14. Valve 62 on line 60 (which is a cascade line taking condensate from heat exchanger unit 20 and returning it via valve 62, line 63 and pump 61 to main boiler feed water line 14A) is closed, forcing the BFW through line 63 to pump 61 and thereby into line 14A. Valve 66 closes the latter portion of line 14A and forces the BFW to travel through conduit $C^1$ wherein it is brought into heat exchanger relationship in heat exchanger unit 39 with the hot LVP material moving from storage means 37 to means 40 through conduit 38. The now fully preheated BFW proceeds through conduit C, through junction Z and thence to the boiler by the standard means described in FIG. 1.

This scheme, while involving additional interconnections between the nuclear plant and the storage location has the advantage of being able to utilize low pressure lines and heat exchanger means for a portion of the system. The transfer lines A, $A^1$, $A^{11}$ and $A^{111}$ and line 14 and all the heat exchanger units on line 14 can be of low pressure, low temperature design and capacity.

In a single loop system, as illustrated in FIG. 1 for example, these units and line 14 had to be of high temperature and pressure design and capacity, thereby representing a major cost disadvantage. With the instant scheme 5 only line C and $C^1$, main line 14a and the exchanger units thereon need be of high pressure-high temperature design and capacity. FIG. 5 thereby represents a system with major cost and efficiency benefits.

Finally, it must be understood that the concept presented in the above-described Figures merely represents one possible embodiment of the invention, variations on the main theme being within the scope of those skilled in the art. In place of reinjecting the excess intermediate pressure steam into the main turbine, this steam can be injected into a separate "peaking" turbine-generator or it can be used to drive auxiliaries.

Also, a number of these schemes can easily be combined. Thus, the two-loop system of FIG. 5 can be utilized in the interstage steam reheat system of FIG. 3, which in turn, may have some intermediate pressure steam production and reinjection described in FIG. 4.

What is claimed is:

1. A process for efficiently utilizing the heat output of a constant output nuclear reactor or fossil fuel furnace and boiler in an electricity generating plant and enabling the plant to achieve flexible power output which comprises the steps of:

a. using extraction steam and primary high pressure steam to heat boiler feed water in heat exchanger means;

b. shunting a portion of the hot boiler feed water during periods of low power demand to oil-water heat exchanger means;

c. moving low vapor pressure organic heat retention material from cold storage means to hot storage means through the oil-water heat exchanger means of (b);

d. heating low vapor pressure organic heat retention material in the oil-water heat exchanger means by means of the hot boiler feed water of (b);

e. storing the hot low vapor pressure organic heat retention material at atmospheric pressure in isolation from the atmosphere in a hot storage location means;

f. during periods of peak power demand curtailing boiler feed water heating by extraction steam and primary high pressure steam in the heat exchanger means of (a);

g. reversing the flow of the shunted portion of boiler feed water so that cold boiler feed water passes through the oil-water heat exchanger means of (c);
h. moving hot low-vapor pressure organic heat retention material from hot storage location means to cold storage location means;
i. passing the moving hot low vapor pressure organic heat retention material through the oil-water heat exchanger means;
j. heating the cold boiler feed water passing through the oil-water heat exchanger means by means of the moving hot low vapor pressure organic thermal energy retention material moving from hot to cold storage location means;
k. passing the hot boiler feed water to the boiler.

2. A process for efficiently utilizing the heat output of a constant output nuclear reactor or fossil fuel furnace and boiler in an electricity generating plant and enabling the plant to achieve flexibility in power generation which comprises the steps of:

a. using extraction steam and primary high pressure steam to heat boiler feed water in heat exchanger means;
b. shunting a portion of the hot boiler feed water during periods of low power demand to oil-water heat exchanger means;
c. heating low vapor pressure organic heat retention material in the oil-water heat exchanger means by means of hot boiler feed water;
d. storing the hot low vapor pressure organic heat retention material at atmospheric pressure in isolation from the atmosphere in a hot storage location means;
e. storing the partially cooled boiler feed water of steps (b), (c) and (d) in a hot water storage means;
f. during periods of peak power demand curtailing boiler feed water heating by extraction steam and primary high pressure steam in the heat exchanger means of (a);
g. reversing the flow of the shunted portion of the boiler feed water so that cold boiler feed water passes through the oil-water heat exchanger means of (c);
h. using the stored hot water of (e) as partially heated boiler feed water moving through the oil-water heat exchanger means of (c);
i. moving hot low vapor pressure organic heat retention material from hot storage location means to cold storage location means through the oil-water heat exchanger means;
j. heating the boiler feed water passing through the oil-water heat exchanger means by means of the moving hot low vapor pressure organic heat retention material moving from hot to cold storage location means;
k. passing the hot boiler feed water to the boiler.

3. The process of claim 2 wherein the stored hot water is partially heated boiler feed water coming from heat exchanger means heated with extraction steam.

4. The process of claim 2 wherein the stored hot water is mixed with cold water which has been partially heated by means of low level extraction steam which stored hot water and partially heated cold water is the cold boiler feed water of (g).

5. The process of claim 1 further characterized in that (a) the heating of low vapor pressure organic heat retention material in the oil-water heat exchanger means by means of hot boiler feed water practiced in step (d) is to a temperature of from 450° to 600° F. (b) the low vapor pressure organic heat retention material stored in step (j) after being used to heat boiler feed water is stored at a temperature of about 190° F.

6. A process wherein the boiler feed water is preheated during peak demand periods by the stored hot LVP organic heat retention material of the claim 1 process to a temperature in excess of the temperature of admission to the boiler and is used as turbine interstage steam reheat material before being passed to the boiler.

7. A process wherein the boiler feed water is preheated during peak demand periods by the stored hot Low Vapor Pressure organic heat retention material of claim 2 process to a temperature in excess of the temperature of admission to the boiler and is used as turbine interstage steam reheat material before being passed to the boiler.

8. A process for efficiently utilizing the heat output of a constant output nuclear reactor or fossil fuel furnace and boiler in an electricity generating plant and enabling the plant to achieve flexibility in power output which comprises the steps of:

a. using extraction steam and primary high pressure steam to heat boiler feed water in water-steam heat exchanger means;
b. passing the partially expended turbine extraction steam and primary high pressure steam to oil-water steam heat exchanger means during periods of low power demand;
c. heating low vapor pressure organic heat retention material in the oil-water steam heat exchanger means using the steam of step (b);
d. storing the hot LVP organic heat retention material at atmospheric pressure in isolation from the atmosphere in a hot storage location means;
e. during periods of peak power demand moving hot LVP organic heat retention material from hot to cold storage means through oil-water heat exchanger means.
f. heating cold circulating water in the oil-water exchanger means of (e) thereby generating steam at various pressure levels;
g. passing said steam from step (f) to the watersteam heat exchanger means of step (a);
h. heating boiler feed water in the water-boiler feed water steam heat exchanger means of (g) by means of steam raised in step (f);
i. using any excess of the steam raised in step (f) over and above the requirement of step (h) as high and low pressure motive steam in a turbine;
j. passing the hot boiler feed water to the boiler.

9. A process for efficiently utilizing the heat output of a constant output nuclear reactor or fossil fuel furnace and boiler in an electricity generating plant and enabling the plant to achieve flexible power output which comprises the steps of:

a. using extraction steam and primary high pressure steam to heat boiler feed water in heat exchanger means;
b. shunting a portion of the boiler feed water heated by means of low pressure extraction steam during low power demand periods to low pressure oil-water heat exchanger means;
c. shunting a portion of the boiler feed water heated by means of high pressure extraction steam and primary high pressure steam during periods of low power demand to high pressure oil-water heat exchanger means;

d. heating low vapor pressure organic heat retention material in the oil-water heat exchanger means heated by the above-identified separate circuits of boiler feed water heated by (1) low pressure extraction steam and (2) high pressure extraction and primary high pressure steam;

e. storing the hot LVP organic heat retention material at atmospheric pressure in isolation from the atmosphere in hot storage location means;

f. during periods of peak power demand curtailing boiler feed water heating by extraction and primary high pressure steam in the heat exchanger means of (a);

g. reversing the flow of the shunted portion of boiler feed water so that cold boiler feed water passes through the multiple oil-water heat exchanger means of (d);

h. moving hot LVP organic heat retention material from hot storage means to cold storage means;

i. passing the moving hot LVP organic heat retention material through the oil-water-heat exchanger means;

j. heating the cold boiler feed water first in the low pressure circuit then passing the partially heated boiler feed water to a second circuit comprising high pressure oil-water heat exchanger means;

k. further heating the partially heated boiler feed water in the second circuit high pressure oil-water heat exchanger means of (j) by the moving hot LVP organic heat retention material;

l. passing the hot boiler feed water to the boiler.

10. A process wherein boiler feed water is preheated to a temperature in excess of the temperature of admission to the boiler by means of stored hot LVP organic heat retention material moving from hot storage means to cold storage means through heat exchangers and is used as turbine interstage steam reheat material before being passed to the boiler.

11. The process of claim 1 wherein the curtailed practiced in step (f) consists of reducing boiler feed water heating by extraction steam and primary high pressure steam in the heat exchanger means of (a).

12. The process of claim 1 wherein the curtailing practiced in step (f) consists of terminating boiler feed water heating by extraction steam and primary high pressure steam in the heat exchanger means of (a).

13. The process of claim 2 wherein the curtailing practiced in step (f) consists of reducing the boiler feed water heating by extraction and primary high pressure steam in the heat exchange means of (a).

14. The process of claim 2 wherein the curtailing practiced in step (f) consists of terminating the boiler feed water heating by extraction and primary high pressure steam in the heat exchanger means of (a).

15. The process of claim 9 wherein the curtailing practiced in step (f) consists of reducing the boiler feed water heating by extraction and primary high pressure steam in the heat exchanger means of (a).

16. The process of claim 9 wherein the curtailing practiced in step (f) consists of terminating the boiler feed water heating by extraction and primary high pressure steam in the heat exchanger means of (a).

17. The process of claim 2 further characterized in that (a) the heating of low vapor pressure organic heat retention material in oil-water heat exchanger means by means of hot boiler feed water as practiced in step (c) is to a temperature of from 450° to 600° F. (b) the low vapor pressure organic heat retention material stored in step (j) after being used to heat boiler feed water is stored at a temperature of about 190° F.

18. The process of claim 8 further characterized in that (a) the heating of low vapor pressure organic heat retention material in oil-water steam heat exchanger means using steam as practiced in step (c) is to a temperature of from 450° to 600° F. and (b) the low vapor pressure organic heat retention material stored in step (c) after being used to generate steam in step (f) is stored at a temperature of about 190° F.

19. The process of claim 9 further characterized in that (a) the heating of low vapor pressure organic heat retention material in oil-water heat exchanger means as practiced in step (d) is to a temperature of from 450° to 600° F. and (b) the low vapor pressure organic heat retention material stored in step (h) after being used to heat boiler feed water in step (k) is stored at a temperature of about 190° F.

* * * * *